US005913614A

United States Patent [19]

Smith et al.

[11] Patent Number: 5,913,614

[45] Date of Patent: Jun. 22, 1999

[54] RECIRCULATING PLUMBING SYSTEM

[76] Inventors: James Andrew Smith, 378 East Burnside Road, Victoria, British Columbia, Canada, V9A 1A5; John Ross Elliott, 4590 209A Street, Langley, British Columbia, Canada, V3A 2K9; Michael E.S. Lawrence, 776 Treanor Avenue, Victoria, British Columbia, Canada, V9B 5V5

[21] Appl. No.: 08/864,017

[22] Filed: May 27, 1997

[51] Int. Cl.[6] ..... E03C 1/044

[52] U.S. Cl. ..... 4/668; 236/12.12

[58] Field of Search ..... 236/12.12, 12.15; 4/668; 137/334

[56] References Cited

U.S. PATENT DOCUMENTS

| | | | |
|---|---|---|---|
| 4,359,186 | 11/1982 | Kiendl | 236/12.12 |
| 4,406,401 | 9/1983 | Nettro | 236/12.15 |
| 4,528,709 | 7/1985 | Getz | 236/12.12 |
| 4,909,435 | 3/1990 | Kidouchi et al. | 236/12.12 |
| 5,439,019 | 8/1995 | Quandt et al. | 236/12.12 |
| 5,459,890 | 10/1995 | Jarocki | 236/12.12 |
| 5,577,660 | 11/1996 | Hansen | 236/12.12 |

*Primary Examiner*—William E. Tapolcai

*Attorney, Agent, or Firm*—Christensen O'Connor Johnson & Kindness PLLC

[57] ABSTRACT

A water conservation and delivery system for a building includes a first subsystem for dispensing clean water from a faucet, a second subsystem for draining waste water from the vessel supplied by the faucet, and a third subsystem for recirculating clean water prior to dispensement back into the dispensing subsystem while the dispensing temperature and flow are adjusted.

23 Claims, 1 Drawing Sheet

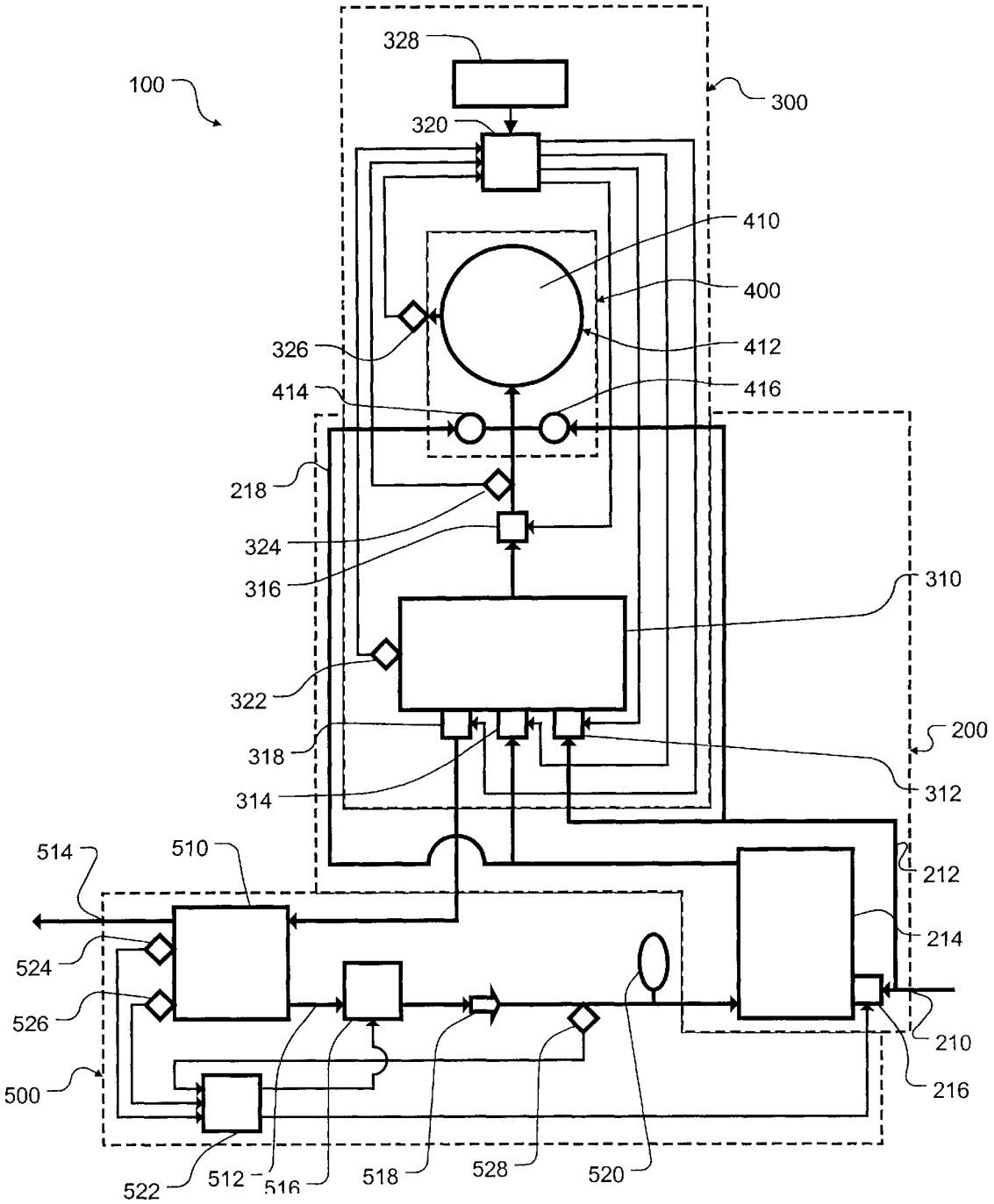
100
328
300
320
410
400
326
412
414
416
218
324
316
310
322
200
318
312
314
514
510
212
214
524
526
210
500
216
522
512
516
518
528
520

RECIRCULATING PLUMBING SYSTEM

FIELD OF THE INVENTION

This invention relates to water delivery systems for buildings and vehicles. More specifically, the invention relates to a system that recirculates for later use water that is hotter or colder than currently desired.

BACKGROUND OF THE INVENTION

Conventional plumbing systems are wasteful; they waste water and they waste the energy used to heat the water. For example, when a person tests or adjusts the temperature of water dispensed from a faucet, water that is too cold or too hot is generally spilled down the drain and wasted. A utility expended resources to acquire, store, treat, and deliver that water; the building owner paid money to buy and heat that water.

When such wastage occurs throughout a whole building or a whole utility, the losses are significant. Reducing such wastage would decrease expenses for landlords and hoteliers, and would allow utilities to build smaller reservoir, treatment and delivery systems for a given number of customers. In areas where water is scarce, a reduction in wastage might lead to a reduction in rationing. A system for reducing wastage might similarly find advantageous use on planes, boats and recreational vehicles that carry water subject to weight or space limitations.

The fundamental disadvantage in a conventional plumbing system is that it has only two types of pipes: incoming pipes for delivering clean water and outgoing pipes for removing waste water. Clean water dispensed at an incorrect temperature has no place to go except down the drain with the waste water. What is needed is a plumbing system that provides for recirculation of clean water dispensed at the wrong temperature.

The present invention is directed to such a system.

SUMMARY OF THE INVENTION

According to one aspect of the invention there is provided a system for supplying a mixture of fluid from first and second sources to a consumption device comprising: a mixing vessel having: a mixing chamber, a first valved inlet adapted to receive fluid from the first source for mixing in the mixing chamber, a second valved inlet adapted to receive fluid from the second source for mixing in the mixing chamber, and a first valved outlet adapted to dispense fluid mixed in the mixing chamber into the consumption device, as well as means for sensing the temperature of the fluid mixture inside the mixing chamber, and means for controlling the first valved inlet responsive to the temperature sensing means. The system might further include means for controlling the second valved inlet responsive to the temperature sensing means, means for sensing the rate of flow of fluid through the first valved outlet, and means for controlling the first valved outlet responsive to the flow rate sensing means. The system might also include means for sensing the amount of fluid dispensed into the consumption device where such means might be a fluid level detector or a timer. The system could further include means for controlling the first valved outlet responsive to the amount sensing means and such controlling means can include a microprocessor. The system might further include a holding tank, wherein the mixing vessel further includes a second valved outlet adapted to discharge water into the holding device. The system might include means for controlling the second valved outlet responsive to the temperature sensing means and means for reinjecting fluid from the holding tank into the first source. The reinjecting means might include a pump connected to draw fluid from the holding tank toward the first source, a check valve connected to receive fluid from the holding tank and to supply the fluid to the first source, means for controlling the pump responsive to the fluid level in the holding tank which pump controlling means might be a microprocessor, means for controlling the pump responsive to the fluid pressure at the first source, and means for damping pressure transients where the pressure damping means might be a pressure accumulator.

According to another aspect of the invention, there is provided a method of supplying a mixture of fluid from first and second sources to a consumption device comprising: connecting a mixing vessel having a mixing chamber with a first valved inlet, a second valved inlet, and a first valved outlet to the first and second sources and the consumption device such that: the first valved inlet receives fluid from the first source for mixing in the mixing chamber, the second valved inlet receives fluid from the second source for mixing in the mixing chamber, and the first valved outlet dispenses fluid mixed in the mixing chamber into the consumption device, sensing the temperature of the fluid mixture inside the mixing chamber, and controlling the first valved inlet responsive to the temperature in the mixing chamber. The method might include controlling the second valved inlet responsive to the temperature in the mixing chamber, sensing the rate of flow of fluid through the first valved outlet, controlling the first valved outlet responsive to the flow rate, sensing the amount of fluid dispensed into the consumption device, and controlling the first valved outlet responsive to the amount of fluid dispensed into the consumption device. The method might further include connecting a second valved outlet in the mixing chamber to a holding tank such that second valved outlet discharges fluid mixed in the mixing chamber into the holding tank. The method might include controlling the second valved outlet responsive to the temperature in the mixing chamber, and reinjecting fluid from the holding tank into the first source, wherein the reinjecting step is executed with a pump connected to draw fluid from the holding tank toward the first source. The method might include controlling the pump responsive to the fluid level in the holding tank, and controlling the pump responsive to the fluid pressure at the first source, and damping pressure transients between the pump and the first source.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawing which is a schematic diagram of a plumbing system embodying one aspect of the invention.

DETAILED DESCRIPTION OF THE PREFERRED EMBODIMENT

With reference now to the drawing, a plumbing system 100 embodying one aspect of the invention includes a supply subsystem generally illustrated at 200, a mixing subsystem generally illustrated at 300 connected to receive water from the supply subsystem 200, a consumption subsystem generally illustrated at 400 connected to receive water from the mixing subsystem 300, and a recirculation subsystem generally illustrated at 500 connected to receive water from the mixing subsystem 300 and to recirculate it into the supply subsystem 200.

The supply subsystem 200 begins at a cold water inlet 210 which is connected to receive water from the mains. The cold water inlet 210 feeds a cold water line 212. The cold water inlet 210 also feeds a water heater 214 through a heater valve 216. The water heater 214 in turn feeds a hot water line 218.

The mixing subsystem 300 is formed around a mixing chamber 310. The mixing chamber 310 is connected to receive cold water from the cold water line 212 through a cold water inlet valve 312 and connected to receive hot water from the hot water line 218 through a hot water inlet valve 314. As will be described further under system operation, the mixing chamber 310 is connected to dispense water into the consumption subsystem 400 through a dispensing valve 316 and connected to discharge water into the recirculation subsystem 500 through a recirculation valve 318.

The mixing subsystem 300 is controlled by a mixing microprocessor 320. The mixing microprocessor 320 is connected to receive information signals from a temperature sensor 322 in the mixing chamber 310, from a flow sensor 324 at the dispensing valve 316, from a quantity sensor 326, such as a fluid level detector, at the consumption subsystem 400 and from an operator keypad 328. The mixing microprocessor 320 is connected to control the cold water input valve 312, the hot water input valve 314, the output valve 316 and the recirculation valve 318.

The consumption subsystem 400 includes a consumption device 410 such as a sink, a tub or a shower which has an inlet port 412 connected to receive water from the mixing subsystem 300 dispensing valve 316. The consumption device 410 might also include a hot water bypass valve 414 connected to receive water directly from the hot water line 218 and a cold water bypass valve 416 connected to receive water directly from the cold water line 212 without engaging the mixing subsystem 300. These bypass valves 412, 416 would be normally closed but could be opened to operate the consumption device 410 when the mixing subsystem 300 was not operational.

The recirculation subsystem 500 includes an insulated holding tank 510 that is connected to receive water from the mixing subsystem 300 recirculation valve 318. The holding tank 510 includes a reinjection outlet 512 as well as an emergency overflow outlet 514. The reinjection outlet 512 is connected to feed the hot water heater 214 via a reinjection pump 516, a check valve 518, and a pressure accumulator 520. A recirculation microprocessor 522 is connected to receive information signals from a maximum level sensor 524 and a minimum level sensor 526 in the holding tank 510, and from a line pressure sensor 528 between the check valve 518 and the pressure accumulator 520. The recirculation microprocessor 522 is connected to control the reinjection pump 516 and the heater valve 216.

In operation, the operator uses the keypad 328 to instruct the mixing microprocessor 320 to dispense water to the consumption device 410. The operator can select such characteristics for the water as temperature, quantity, flow rate, or flow duration. The mixing microprocessor 320 opens the cold water input valve 312 and/or the hot water input valve 314 to bring water into the mixing chamber 310 in approximately the right proportion to achieve the temperature selected. If the temperature sensor 322 indicates that the water mixture inside the mixing chamber 310 is not at the temperature selected by the operator, the mixing microprocessor 320 adjusts the cold water input valve 312 and/or the hot water input valve 314 as needed and opens the recirculation valve 318 to discharge the water mixture* into the recirculation subsystem 500 for later use. If the temperature sensor 322 indicates that the water mixture inside the mixing chamber 310 is at the temperature selected by the operator, the mixing microprocessor 320 closes the recirculation valve 318 and opens the dispensing valve 316, thereby allowing the mixed water to flow into the consumption subsystem 400. The flow sensor 324 at the dispensing valve 316 and the quantity sensor 326 at the consumption device 410 provide the mixing microprocessor with the information needed to adjust the dispensing valve 316 such that the right amount of water is dispensed for the right amount of time at the right pressure.

Recirculated water is stored in the insulated holding tank 510 for subsequent reinjection into the hot water tank 214. When the water in the holding tank 510 rises above a maximum preset level, the maximum level sensor 524 informs the recirculation microprocessor 522. The recirculation microprocessor 522 closes the heater valve 216 to isolate the hot water tank 214 from the mains and then checks the pressure sensor 528 to determine whether the hot water tank 214 is already filled to capacity. If so, the recirculation microprocessor 522 will continue to monitor the recirculation system 500 but will not engage any device. If the holding tank 510 continues to fill under such conditions, excess water may eventually spill from the emergency overflow outlet 514.

When the pressure sensor 528 indicates to the recirculation microprocessor 522 that the hot water tank 214 can accept water, the recirculation microprocessor 522 turns on the reinjection pump 516. The reinjection pump 516 discharges water from the holding tank 510 through the check valve 518 into the hot water tank 214 via the pressure accumulator 520. Water being incompressible, the pressure accumulator 520 is used as a means to discourage the line pressure from increasing rapidly the moment the pump 516 is engaged. If the line pressure were allowed to rise unchecked, the pressure sensor 528 would detect falsely that the hot water tank 214 was full and would incorrectly indicate to the recirculation microprocessor 522 that the pump 516 must be stopped immediately after it is started.

When the pressure sensor 528 indicates to the recirculation microprocessor 522 that the hot water tank 214 is full, the recirculation microprocessor 522 stops the reinjection pump 516. When the minimum level sensor 526 indicates to the recirculation microprocessor 522 that the water level in the holding tank 510 has fallen below a minimum level, the recirculation microprocessor 522 stops the reinjection pump 516 and opens the heater valve 216 to reconnect the hot water tank 214 to the mains.

Although a specific embodiment of the present invention has been described and illustrated, the present invention is not limited to the features of this embodiment, but includes all variations and modifications within the scope of the claims.

For example, it is contemplated that more than one consumption subsystem 400 could be connected to the system 100.

It is also contemplated that either microprocessor 320, 522 could be replaced by other electronic control devices or even a mechanical equivalent. For example, much of the functionality of the mixing microprocessor 320 could be achieved by a set of mechanical thermostats.

It is further contemplated that the recirculation subsystem 500 could be easily adapted to work with gravity fed plumbing systems such as those commonly found in parts of Europe and the United Kingdom. In particular, the expansion tank could function directly as the holding tank 510 so that the recirculation pump 516 and its accompanying control system would not be needed.

It is still further contemplated that the mixing subsystem 300 could be constructed as either an integral part of the consumption device 410 or as a retrofitable addition.

While the preferred embodiment of the invention has been illustrated and described, it will be appreciated that various changes can be made therein without departing from the spirit and scope of the invention.

The embodiments of the invention in which an exclusive property or privilege is claimed are defined as follows:

1. A system for supplying a mixture of fluid from first and second sources to a consumption device, comprising:

(a) a holding tank, (b) a mixing vessel, having:

(i) a mixing chamber, (ii) a first valved inlet adapted to receive fluid from the first source for mixing in the mixing chamber, (iii) a second valved input adapted to receive fluid from the second source for mixing in the mixing chamber, (iv) a first valved outlet adapted to dispense fluid from the mixing chamber into the consumption device, and (v) a second valved outlet adapted to discharge fluid from the mixing chamber into the holding tank, (c) means for sensing the temperature of the fluid mixture inside the mixing chamber, (d) means for controlling the first valved inlet responsive to the means for sensing the temperature of the fluid mixture inside the mixing chamber, and (e) means for reinjecting fluid from the holding tank into the first source, the means for reinjecting including:

(i) a pump connected to draw fluid from the holding tank toward the first source, and (ii) means for controlling the pump responsive to the fluid pressure at the first source.

2. A system as in claim 1, wherein the means for reinjecting further includes means for damping fluid pressure transients between the pump and the first source.

3. A system as in claim 2, wherein the means for damping pressure transients is a pressure accumulator.

4. A system as in claim 3, wherein the means for reinjecting further includes a check valve connected to receive fluid from the holding tank and to supply the fluid to the first source.

5. A system as in claim 2, wherein the means for reinjecting further includes means for controlling the pump responsive to the fluid level in the holding tank.

6. A system as in claim 2, further including means for controlling the second valved outlet responsive to the means for sensing the temperature of the fluid mixture inside the mixing chamber.

7. A system as in claim 2, further including means for sensing the rate of flow of fluid through the first valved outlet.

8. A system as in claim 7, further including means for controlling the first valved outlet responsive to the means for sensing the rate of flow of fluid through the first valved outlet.

9. A system as in claim 2, further including means for sensing the amount of fluid dispensed into the consumption device.

10. A system as in claim 9, further including means for controlling the first valved outlet responsive to the means for sensing the amount of fluid dispensed into the consumption device.

11. A system as in claim 10, wherein the means for sensing the amount of fluid dispensed into the consumption device is a fluid level detector.

12. A system as in claim 10, wherein the means for sensing the amount of fluid dispensed into the consumption device is a timer.

13. A system as in claim 2, wherein the means for controlling the pump responsive to the fluid pressure at the first source is the first microprocessor.

14. A system as in claim 2, wherein the means for controlling the first valved inlet responsive to the means for sensing the temperature of the fluid mixture inside the mixing chamber is a second microprocessor.

15. A system as in claim 5, wherein the means for controlling the pump responsive to the fluid level in the holding tank is a first microprocessor.

16. A system as in claim 6, wherein the means for controlling the second valved outlet responsive to the means for sensing the temperature of the fluid mixture inside the mixing chamber is the second microprocessor.

17. A method of supplying a mixture of fluid from first and second sources to a consumption device, comprising:

(a) connecting a mixing vessel having a mixing chamber with a first valved inlet, a second valved inlet, and a first valved outlet to the first and second sources and the consumption device, such that:

(i) the first valved inlet receives fluid from the first source for mixing in the mixing chamber, (ii) the second valved inlet receives fluid from the second source for mixing in the mixing chamber, and (iii) the first valved outlet dispenses fluid mixed in the mixing chamber into the consumption device, (b) sensing the temperature of the fluid mixture inside the mixing chamber, (c) controlling the first valved inlet responsive to the temperature in the mixing chamber, (d) connecting a second valved outlet from the mixing chamber to a holding tank such that the second valved outlet discharges fluid mixed in the mixing chamber into the holding tank, (e) reinjecting fluid from the holding tank into the first source with a pump connected to draw fluid from the holding tank toward the first source, and (f) controlling the pump responsive to the fluid pressure at the first source.

18. A method as in claim 17, further including damping fluid pressure transients between the pump and the first source.

19. A method as in claim 18, further including controlling the pump responsive to the fluid level in the holding tank.

20. A method as in claim 18, further including controlling the second valved outlet responsive to the temperature in the mixing chamber.

21. A method as in claim 18, further including controlling the second valved inlet responsive to the temperature in the mixing chamber.

22. A method as in claim 18, further including:

(a) sensing the rate of flow of fluid through the first valved outlet, and (b) controlling the first valved outlet responsive to the rate of flow of fluid through the first valved outlet.

23. A method as in claim 18, further including:

(a) sensing the amount of fluid dispensed into the consumption device, and (b) controlling the first valved outlet responsive to the amount of fluid dispensed into the consumption device.

* * * * *

UNITED STATES PATENT AND TRADEMARK OFFICE

CERTIFICATE OF CORRECTION

PATENT NO. : 5,913,614

DATED : June 22, 1999

INVENTOR(S) : J.A. Smith et al.

It is certified that error appears in the above-identified patent and that said Letters Patent is hereby corrected as shown below:

| COLUMN | LINE | |
|---|---|---|
| [30] Pg. 1, col. 1 | Foreign Appl. Priority Data | Before the line beginning with "[51] Int. Cl.$^{6}$" please insert: --[30] Foreign Application Priority Data May 29, 1996 [CA] Canada . . . 2,177,624-- |

Signed and Sealed this

Eighth Day of February, 2000

*Attest:*

*Attesting Officer*

Q. TODD DICKINSON

*Commissioner of Patents and Trademarks*